United States Patent [19]

Herz

[11] 4,189,035

[45] Feb. 19, 1980

[54] GARMENT CONTAINER, CARRIER AND HANGER

[76] Inventor: Kurt P. Herz, 12-11 43rd Ave., Long Island City, N.Y. 11101

[21] Appl. No.: 908,555

[22] Filed: May 22, 1978

Related U.S. Application Data

[63] Continuation-in-part of Ser. No. 738,341, Nov. 3, 1976, abandoned.

[51] Int. Cl.[2] ..... A45C 5/00

[52] U.S. Cl. ..... 190/43; 206/287

[58] Field of Search ..... 190/43; 206/279, 282–285, 206/286, 287, 289, 290, 291

[56] References Cited

U.S. PATENT DOCUMENTS

| | | | |
|---|---|---|---|
| 1,503,460 | 7/1924 | Bremner | 206/287 |
| 1,618,066 | 2/1927 | Dawn | 206/287 |
| 3,034,552 | 5/1962 | Herz | 206/287 X |
| 3,244,261 | 4/1966 | Herz | 190/43 |
| 3,433,335 | 3/1969 | Spitz | 190/43 |

FOREIGN PATENT DOCUMENTS

| | | | |
|---|---|---|---|
| 626557 | 10/1961 | Italy | 190/43 |
| 890958 | 3/1962 | United Kingdom | 190/43 |
| 898062 | 6/1962 | United Kingdom | 190/43 |

*Primary Examiner*—Donald F. Norton

[57] ABSTRACT

A garment cover, hanger, and carrier is provided which encloses suits, coats, capes, dresses, and other wearing apparel in a bag or container for the protection of the garments against wrinkling or becoming soiled which is generally of the type comprising rectangular sacks of proper length to accommodate a given number of articles to be housed upon coat or garment hangers arranged therein; and having suspension hooks extending therefrom in order that they may be hung or suspended from hooks within clothes closets, or in a traveling vehicle such as airplane, automobile, train, bus, marine vessel, etc.

The garment cover, hanger, and carrier of the present invention is particularly characterized by the provision of improved means for holding the garments in position, including, among other things, a box-like structure surrounding the top and upper half of the side-edges of the garment which is accompanied by a closure that tapers downwardly to the bottom of the box-like structure, together with a pair of substantially rectangular and cooperating longitudinally disposed panel members secured to, and oppositely extending inwardly of, the container from the aforementioned side edges.

6 Claims, 6 Drawing Figures

GARMENT CONTAINER, CARRIER AND HANGER

This is a continuation-in-part application of my presently pending application Ser. No. 738,341, filed Nov. 3, 1976 entitled "Garment Container, Carrier and Hanger" (now abandoned).

The present invention relates to a device in the form of a combination garment cover, hanger, and carrier which entirely encloses the garments as hung in full-length or unfolded condition and provided with means whereby the device may be supported from above while fully extended from a garment hook in a clothes closet, suspending instrumentality in a vehicle, etc., the device being of the same general type as those which are disclosed in my following prior United States patents:

| U.S. Pat. No. | Issued | Title |
|---|---|---|
| 3,034,552 | May 15, 1962 | Garment Cover |
| 3,244,261 | April 15, 1966 | Garment Carrier and Hanger |
| 3,299,997 | Jan. 24, 1967 | Case and Garment Carrier |

It is among the objects of the present invention to provide a device of the type generally represented by the aforementioned patents, and which is flexible, foldable along a transverse center-line in the manner of my aforementioned U.S. Pat. No. 3,244,261; and which is characterized, among other things, by a novel internal box-like structure in the upper half of the container which affords unusual protection for particular garments, or particular portions of certain garments, that are placed therewithin, and especially as associated with a pair of substantially rectangular and cooperating longitudinally disposed panel members hingedly secured to, and oppositely extending inwardly of, the container device from the aforementioned side edges.

Another object is the attainment of the foregoing advantages and objectives with such a combined garment cover, hanger and carrier which may be easily packed and unpacked, readily carried when in the transversely folded position; and when empty may be collapsed into a minimum of space for storage purposes.

With the foregoing objects and advantages in view, together with still others which will appear as the following description proceeds, the invention resides in the novel construction, combination and arrangement of parts, as will be described more fully hereinafter, illustrated in the drawings, and particularly pointed out in the claims. In said drawings:

Figure 1:
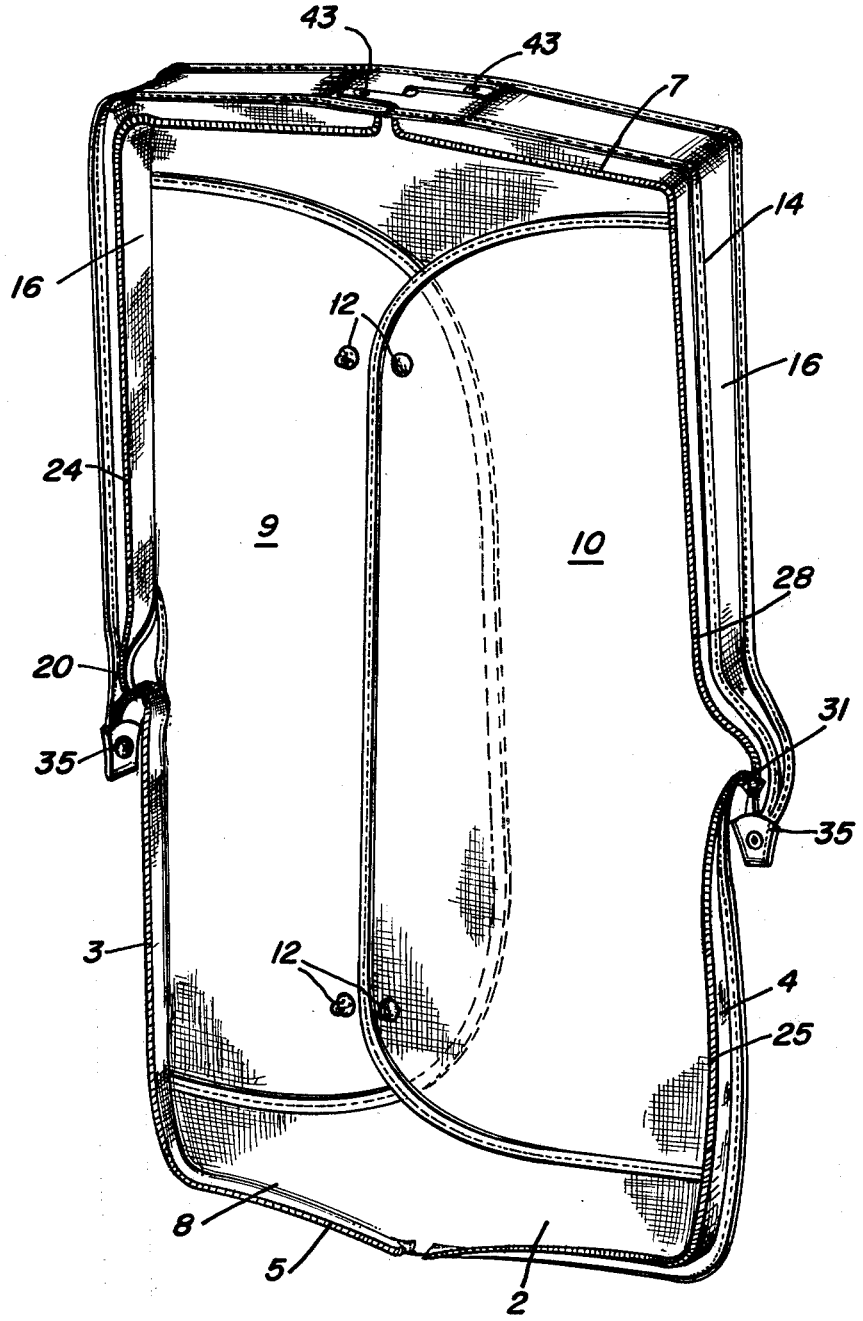
FIG. 1 is a perspective view of the device of the invention in fully opened condition; in order to illustrate all of the components thereof.

Referring more particularly to the drawings, the novel garment cover, hanger, and carrier is formed of suitable flexible material, such as cloth, rubber, leather, plastic, etc., of sufficient length, width and thickness to properly accommodate suits, coats, capes, dresses, and other wearing apparel upon coat or garment hangers whose hooked ends extend through the upper end of the container in a manner to be later described, to afford means whereby the garment hangers and clothing enveloped by the container may be suspended in a suitable location at an appropriate place in a clothes closet, restaurant, travelling vehicle such as airplane, train, bus, marine vessel, etc.

The container or garment cover and carrier, comprises a base sheet 2 which is substantially rectangular, and further defined as possessing parallel and substantially straight side edges 3 and 4, a substantially straight bottom edge 5, and an upper edge 7 which may be substantially straight or somewhat downwardly sloping at each side of its vertical center-line in simulation of the slope of human shoulders.

One of the most important aspects of the invention includes a pair of vertically disposed flaps 9 and 10 which are adapted to function entirely within the container and extend substantially the entire length of the base sheet 2 commencing about three (3) inches below the outer ends of the upper edge of the base sheet. As shown in the drawings, one of these flaps (the right-hand one) indicated at 10 slightly overlaps the other flap 9; and snap fasteners 12 are provided adjacent the upper and lower ends of the vertically disposed flaps 9 and 10; being so disposed as to enable closing of the flaps into several different adjusted positions.

As shown, the remote edges of these vertically depending flaps 9 and 10 are attached to the substantially straight side edges 3 and 4 respectively of the base sheet 2, as by stitching or any other suitable means.

Figure 2:
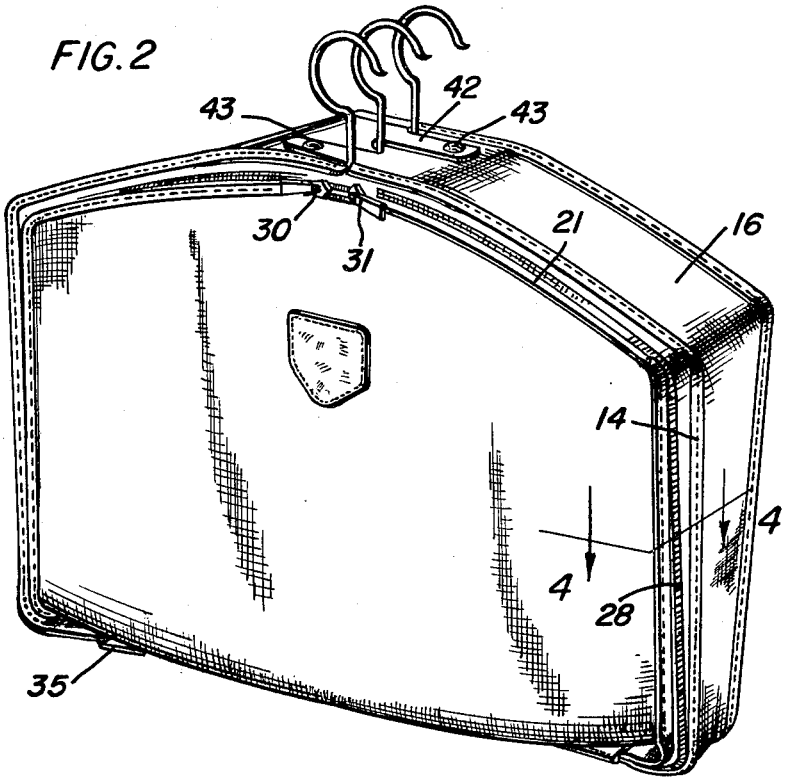
FIG. 2 is a perspective of the device of the invention in its folded condition with the hooks of the garment carriers protruding therefrom.
Figure 3:
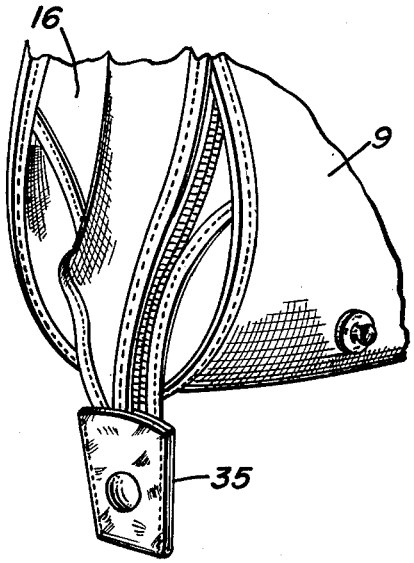
FIG. 3 is a fragmentary view of one end of the device; and more particularly the left-hand end as viewed in FIG. 2.
Figure 4:
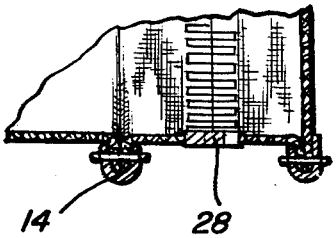
FIG. 4 is a fragmentary view which is taken on the line 4—4 of FIG. 2.
Figure 5:
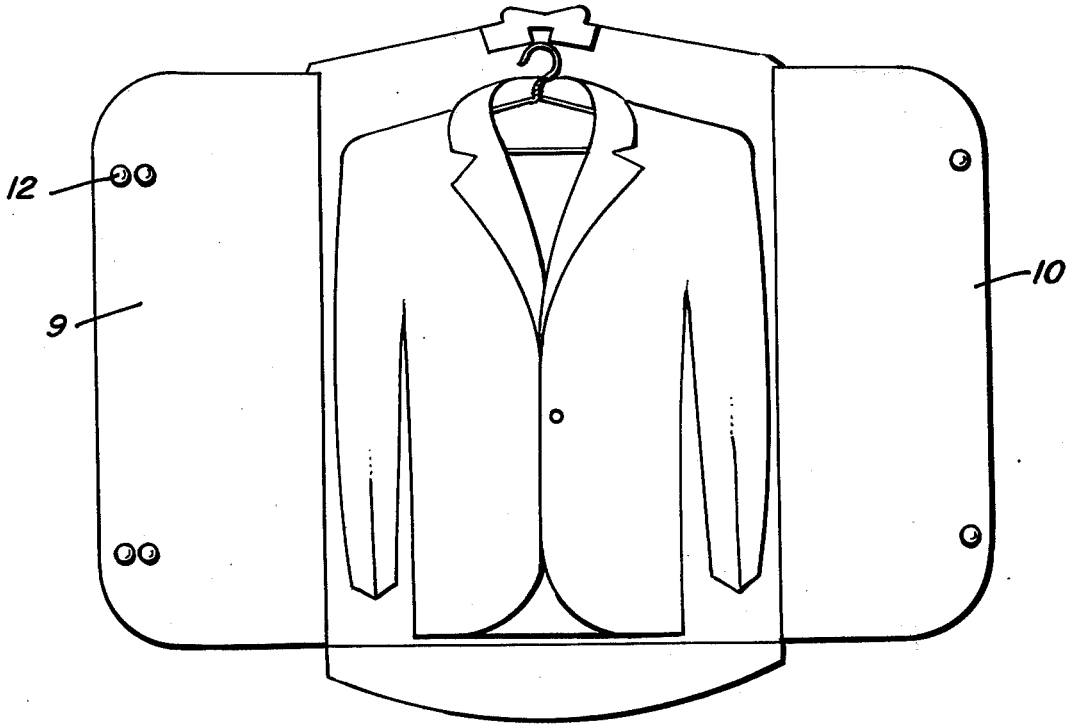
FIG. 5 is a schematic view illustrating the manner in which certain interior portions of the device of the invention operate, and with the interior thereof open.
Figure 6:
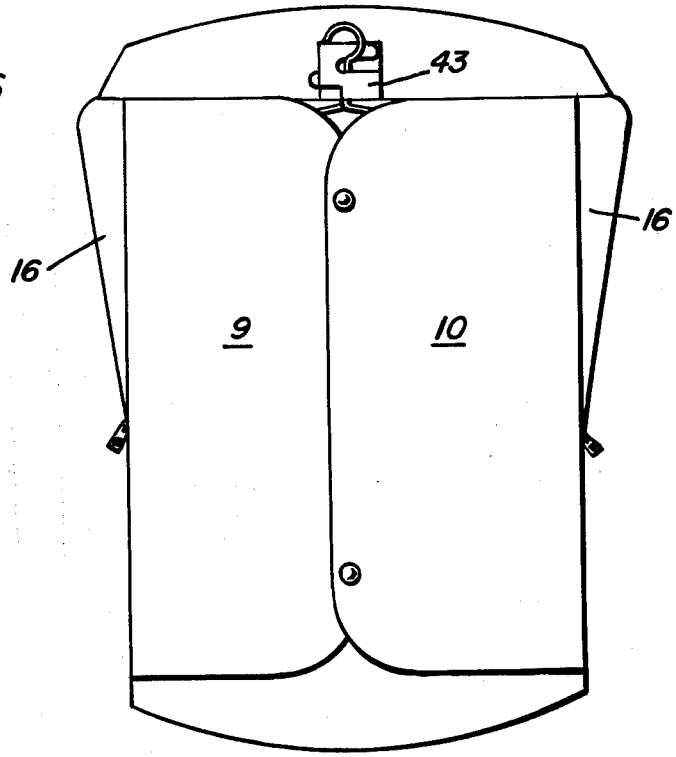
FIG. 6 is a view which is similar to that of FIG. 5, but with the interior closed.

Also forming part of the container, and attached along the line of the upper edge 7 of the base sheet 2, and also along and in parallelism with the upper halves of the substantially straight side edges 3 and 4 of the base sheet 2 is an inverted U-shaped strip 16 which extends right-angularly from the base sheet and is approximately three (3) inches in width, this being the approximate thickness of several or more garments. This inverted U-shaped strip 16 is transversely divided at its middle (the top as shown in FIGS. 1 and 2) to provide for the extension therethrough of the shanks of coat-hangers. This inverted U-shaped strip 16 may be attached to the substantially straight side edges 3 and 4 of the base sheet in the same manner as the remote edges of the aforementioned overlapping vertically disposed flaps 9 and 10.

As will be observed, this strip 16, shaped and constructed in the manner described, is disposed peripherally of the upper halves, the hinged flaps 9 and 10, and extends into the interior of the container as do the flaps when the device of the invention is in closed position.

According to the foregoing construction and arrangement, when the lower half of the substantially rectangular base sheet 2 is folded over the upper half of said base sheet, there is formed a box which is delineated by the inverted U-shaped strip 16 that peripherally encloses or overlaps the top and upper side edges of the garments within the upper half of the container, as well as the adjacent portions of the immediately underlying flaps 9 and 10, when the container is in loaded and closed position.

In order that the immediate foregoing objective may be fully effectuated, each of the extremities of the hereinbefore described inverted U-shaped strip 16 is tapered, as indicated at 20 and 21; and each of said tapered edges serves as the terminal for one end of each of a pair of slide fasteners, as will be described immediately hereinafter.

To the left-hand terminal 20 (as viewed in the drawings) there is attached one end of a slide fastener strip 24 which is co-extensively secured to the outer edge of the left-hand portion of the inverted U-shaped strip 16 and extends upwardly to the longitudinal center-line of the base sheet 2. To the same left-hand terminal 20, there is also connected one end of a slide fastener strip 25 which is adapted to interlock with the slide fastener strip 24. The slide fastener strip 25 is co-extensively connected to the bottom edge 8 of the base sheet 2; and continues upwardly along the lower half of the substantially straight side edge 4 of the substantially rectangular base sheet 2 and is anchored to the right-hand terminal 21 at the lower tapered end of the left-hand portion of the inverted U-shaped strip 16.

To this right-hand terminal 21 at the lower tapered end of the right-hand portion of the inverted U-shaped strip 16 is secured one end of a slide fastener strip 28 which extends upwardly along the right-hand substantially straight side edge 4 to the longitudinal center-line of the base sheet 2.

Each of these terminals 20 and 21 at the lower tapered ends of the inverted U-shaped strip 16 is constructed to receive a slide fastener connector disconnector element as indicated at 30 and 31, respectively; whereby the hereinbefore described and operatively associated slide-fastener strips may be connected when the base sheet 2 is transversely folded over in the manner earlier described, to thereby provide a completely closed box construction, the interior and contents of which are fully protected.

When desired, the slide fastener connector disconnector elements 30 and 31 may be easily and quickly moved into disconnected position(s) whereupon the contents of the container which lie within the box which is delineated by the inverted U-shaped strip 16 and the pair of overlapped flaps 9 and 10 are made readily accessible.

It will be noted that in the interests of efficiency in the folding-over process described, the two (2) terminal elements 20 and 21, the adjoining portions of the container which carry the ends of the other of the two slide fastener strips described are mounted on extensions 35 which are several inches in length. This prevents binding at the edges of the base sheet 2 when in the folded-over position.

As previously mentioned the transverse mid-section of the inverted U-shaped strip 16 is divided and it is provided with reversely extending flexible locking tabs which bridge the transverse division in the manner of my U.S. Pat. No. 3,034,552. These tabs may be formed of the material of which the garment container is made or may be separate layers of material, as here illustrated, stitched or otherwise rigidly secured to the top sections. In the present application, these tabs are indicated at 42, and each is provided at its outer end with a socket member 43 for engagement with a cooperating stud on the opposite top section of the transversely divided upper mid-section of the inverted U-shaped strip 16.

The tabs 42 have their outer edges terminating inwardly of the sides of the container to provide spaces or gaps through which the shanks and hooks of the garment hanger may be extended. Likewise, the adjacent edges of the oppositely directed locking tabs 42 are spaced from one another to provide between them a narrow gap substantially midway of the width of the container and through which other hanger hooks may be projected. By such construction substantially complete sealing of the upper end of the container is assured.

While I have shown and described certain specific embodiments of the present invention, it will be readily understood by those skilled in the art that I do not wish to be limited exactly thereto, since various modifications may be made without departing from the scope of the invention as defined in the appended claims.

I claim:

1. A garment container, carrier and hanger consisting for the most part of flexible material, and, when fully opened and in hanging position, comprising (a) a substantially rectangular base sheet having substantially straight and parallel side edges and substantially straight top and bottom edges;

(b) a pair of substantially rectangular longitudinally disposed and cooperating parallel garment-enclosing panel members hingedly secured at their remote edges to the inner side of the base sheet from both the upper and lower portions of the aforementioned side edges;

(c) an inverted U-shaped strip secured to and extending along said top edge and approximately the upper half of each of said side edges of the base sheet and extending at right-angles with respect to the base sheet;

(d) said inverted U-shaped strip being peripherally disposed with respect to said panel members;

(e) the lower half of said base sheet and said longitudinally disposed panel members being adapted to be folded completely over the upper half thereof; and (f) the upper mid-section of said inverted U-shaped strip being transversely divided and temporarily held together by fastener means which bridge the gap between the transversely divided section;

(g) said gap providing means for receiving the shanks of hook portions of garment hangers and permitting the same to project outwardly therefrom and away from the garment container, carrier and hanger.

2. The garment container, carrier, and hanger of claim 1, and with means for fastening together the adjacent edges of the substantially rectangular longitudinally disposed panel members.

3. The garment container, carrier, and hanger of claim 1, wherein one of the substantially rectangular longitudinally disposed panel members is of sufficient width to overlie the other substantially rectangular longitudinally disposed panel member at least in part; and means for securing said panel members together.

4. The garment container, carrier and hanger of claim 1, together with means for securing together the lower and upper portions of the base sheet and longitudinally disposed panel members when they are in folded relationship.

5. The garment container, carrier, and hanger of claim 4, wherein the securing means includes slide fasteners and slide operators therefor.

6. The garment container, carrier, and hanger of claim 5, wherein the ends of the slide fasteners are secured to the tapered ends of the inverted U-shaped strip.

* * * * *